US007306394B2

(12) United States Patent
Renaudet et al.

(10) Patent No.: US 7,306,394 B2
(45) Date of Patent: Dec. 11, 2007

(54) HINGE DEVICE FOR ATTACHING AT LEAST TWO BRACELET LINKS

(75) Inventors: Yannick Renaudet, Frontenay Rohan (FR); Thierry Bergeon, Villers-le-Lac (FR); Jean-Claude Probst, Saignelégier (CH); Olivier Paratte, Le Noirmont (CH); Yves Bandi, Courtételle (CH); Johnny Buehler, Jongny (CH)

(73) Assignee: Blancpain S.A., Le Brassus (CH)

( * ) Notice: Subject to any disclaimer, the term of this patent is extended or adjusted under 35 U.S.C. 154(b) by 176 days.

(21) Appl. No.: 11/153,378

(22) Filed: Jun. 16, 2005

(65) Prior Publication Data

US 2005/0279134 A1 Dec. 22, 2005

(30) Foreign Application Priority Data

Jun. 16, 2004 (EP) ..... 04014059

(51) Int. Cl.
*F16C 11/00* (2006.01)

(52) U.S. Cl. ..... 403/156; 403/153; 403/154; 59/78; 59/82; 59/84; 59/85; 63/7; 63/9; 63/35; 63/38

(58) Field of Classification Search ..... None
See application file for complete search history.

(56) References Cited

U.S. PATENT DOCUMENTS

| | | | |
|---|---|---|---|
| 2,780,830 | A | 2/1957 | Kammerer, Jr. |
| 6,564,540 | B2 | 5/2003 | Greguitch |

FOREIGN PATENT DOCUMENTS

| | | | |
|---|---|---|---|
| CH | 661 185 | A5 | 7/1987 |
| EP | 0 229 908 | A2 | 7/1987 |

OTHER PUBLICATIONS

European Search Report completed Nov. 17, 2004 in corresponding European Patent Application No. 04 01 4059.

*Primary Examiner*—Jack W. Lavinder
(74) *Attorney, Agent, or Firm*—Griffin & Szipl, P.C.

(57) ABSTRACT

The hinging device (1) for pivotably attaching the links of a bracelet includes a bar (5) comprising at at least one of its ends (8) a hole (9) provided with an inner thread (10), and a screw (11) whose thread is engaged in said inner thread. The bar and the screw are provided with means (14 to 17) allowing an end portion (18) of the bar (5) to rest radially on a portion (19) of the head (13) of the screw (11) to tighten said screw in said bar.

7 Claims, 2 Drawing Sheets

HINGE DEVICE FOR ATTACHING AT LEAST TWO BRACELET LINKS

Figure 1:
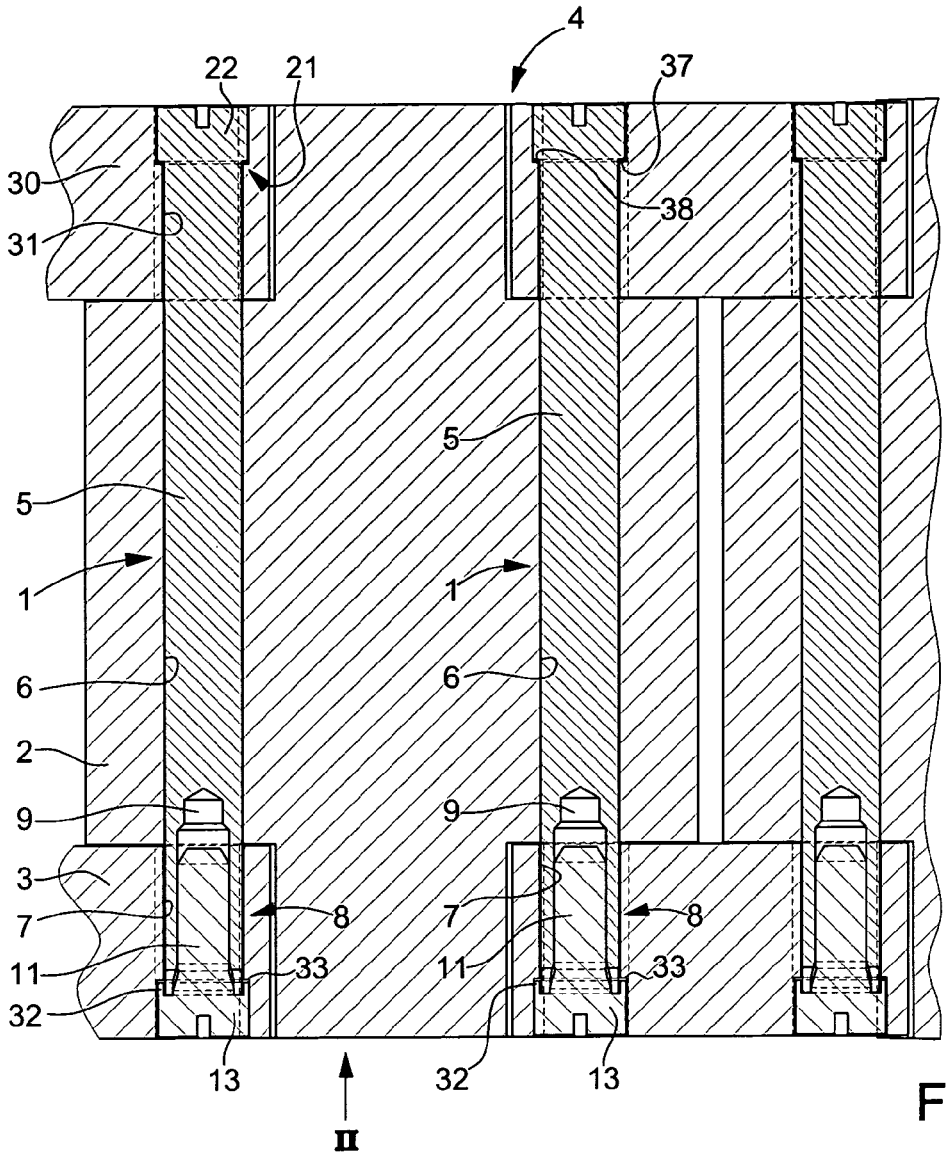

This application claims priority from European Patent Application No. 04014059.2 filed Jun. 16, 2004, the entire disclosure of which is incorporated herein by reference.

The present invention relates to a hinging device for pivotably attaching at least two links of a bracelet, one after the other, this device including a bar passing into bores arranged in the links, said bar comprising at at least one of its ends a hole provided with an inner thread, this device further comprising a screw having a thread engaged in said inner thread and a head arranged for limiting the axial clearance of said bar.

Such a device is known from numerous technical descriptions. A bar is often used which is held in the bores through which it passes by holding means implementing screws whose thread is engaged in an inner thread made in the bar. Generally the screw head has an overhang that abuts against a shoulder of the bore in the link.

One problem that incessantly recurs is holding the bar in place to prevent it from escaping following the incessant movements of the links. One solution has been proposed to this problem. It concerns the hinging device disclosed in CH Patent No. 661185. In this document, the bracelet is formed of a series of links hinged around pivoting bars passing into holes arranged in the links. Each bar ends at one end in a split head and comprises at the other end a hole provided with an inner thread followed by a neck that reduces the section of the hole at that point. A screw provided with a head and a screw thread followed by a groove can be introduced into the hole of the bar then screwed in by force until the neck penetrates the groove of the screw. In this position, the screw is locked owing to the radial elasticity of the bar while being able to be removed from the hole if necessary.

While the solution that has just been described solves the problem of preventing the screw from coming unscrewed following movement of the links, it has several drawbacks. First of all, a problem lies in the fact that the bar, via its split head, occupies a well defined axial position with respect to the links. When the screw is screwed into the hole of the bar, and the groove is in the neck, the links may, because of the play of manufacturing tolerances, be squeezed against each other, which reduces the hinging freedom of said links in relation to each other. If, however, one manages to prevent any squeezing regardless of the tolerances present, the screw heads are liable to overhang the sides of the bracelet, which is unattractive looking and liable to catch against things. Another drawback of the proposed solution lies in the fact that in order to place the screw groove into the neck of the bar, or to remove it therefrom, a significant axial effort is required which will be borne entirely by the screw thread and the inner thread of the bar and which is liable to damage said threads. Finally, it should be mentioned that any screw tightened into its housing, via the axial effort that it instigates, is liable to damage either its thread or the inner thread in which it lodges, when the screw is of very small dimensions, of the order of a millimetre.

In order to overcome the aforementioned drawbacks, the present invention, in addition to answering the generic definition set out in the first paragraph of this description, is characterized in that the bar and the screw are provided with means allowing an end portion of the bar to rest radially on a portion of the screw head to ensure that said screw is tightened in said bar.

Figure 2:
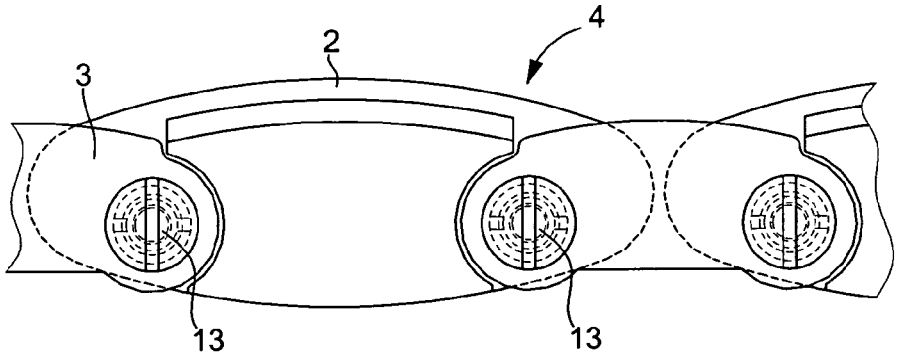
Figure 3:
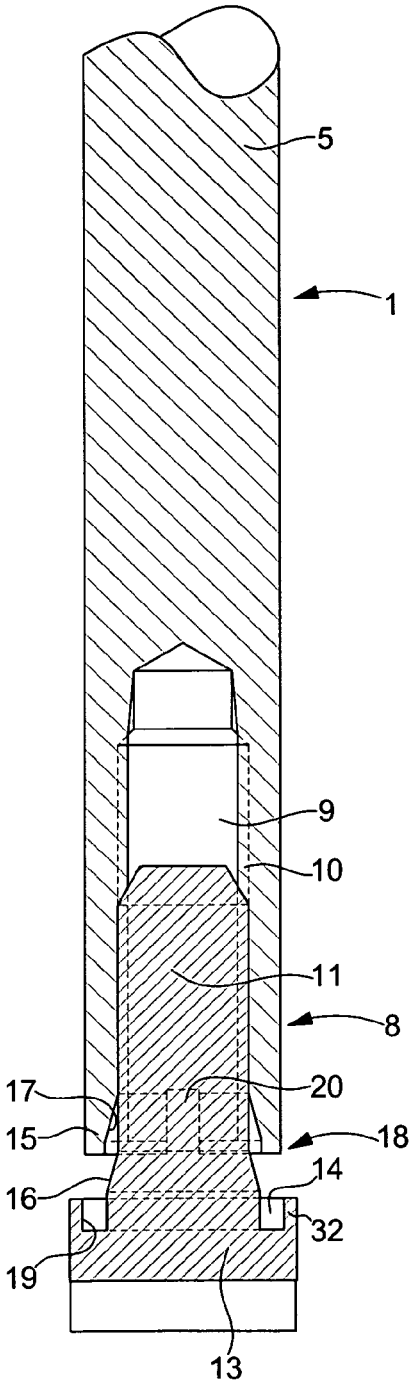
Figure 5:
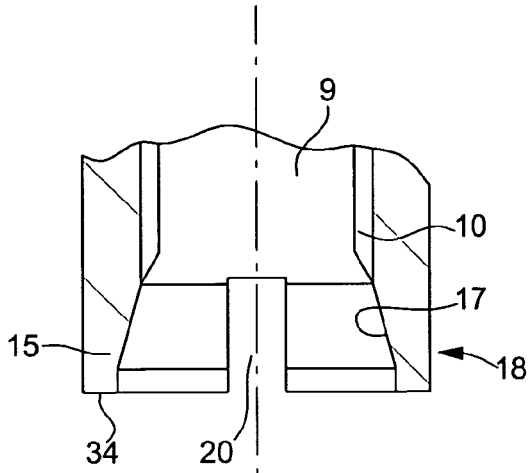
Figure 4:
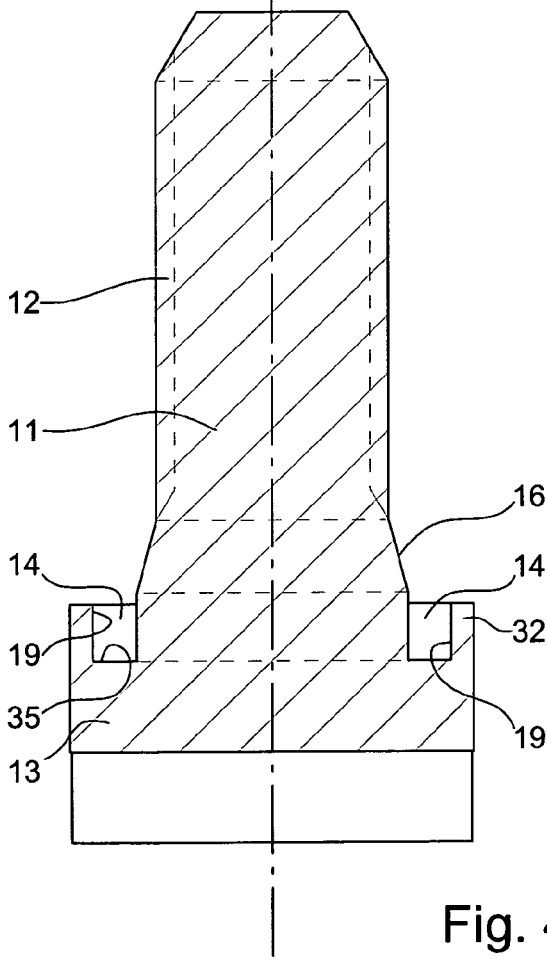

The features and advantages of the present invention will appear from the following description, made with reference to the annexed drawing and giving, by way of explanatory but non-limiting example, an advantageous embodiment of the bracelet hinging device. In the drawing:

FIG. 1 is a cross-section of a part of a bracelet fitted with the hinging device according to the invention, FIG. 2 is a view along arrow II of FIG. 1, FIG. 3 shows the hinging device of the invention comprising one screw, whose thread is partially engaged in the inner thread made at the end of one bar, FIG. 4 shows in enlarged scale the screw shown in FIG. 3, and FIG. 5 shows on the same enlarged scale the end of the bar arranged for receiving the screw of FIG. 4.

As can be seen in FIGS. 1 and 2, a hinging device 1 pivotably attaches a central link 2 and two lateral links 3 and 30 of a bracelet 4. It will also be noted that there could be only two links pivotably attached one after the other as is illustrated in FIG. 1 of the aforecited CH Patent No. A-661185. Hinging device 1 comprises a bar 5 which passes into bores 6, 7 and 31 arranged in said links 2, 3 and 30. Bar 5 includes at at least one of its ends 8, a hole 9 provided with an inner thread 10 (see FIG. 5). Hinging device 1 further includes a screw 11 having a thread 12 (see FIG. 4) engaged in inner thread 10 and a head 13 arranged for limiting the axial clearance of bar 5.

As is apparent in FIG. 1, head 13 is provided with an overhang 32, capable of abutting against a shoulder 33 made in link 3, which thus limits the axial clearance of bar 5. As is apparent in FIG. 3, the present invention is characterized in that bar 5 and screw 11 are provided with means 14, 15, 16 and 17 allowing an end portion 18 of bar 5 to rest radially on a portion 19 of screw head 13 to ensure that said screw is tightened in said bar. The axial tightening effort usually exerted by the thread of the screw on the inner thread of the bar is thus removed and converted into a radial effort exerted by an end portion of the bar on a portion of the screw head. There is thus no longer any risk of damaging the respective thread and inner thread.

The means implemented to make an advantageous embodiment of the invention will now be described in more detail.

As can be seen in the Figures and more particularly in FIGS. 3 to 5, screw head 13 comprises an annular hollow 14 on its back part. The end portion 18 of bar 6 includes a skirt 15 capable of penetrating annular hollow 14. Between threaded part 12 of screw 11 and its head 13 there is arranged a first truncated section 16. This latter is arranged for cooperating with a second truncated section 17 disposed between inner thread 10 of hole 9 of bar 5 and its skirt 15. The first and second truncated sections 16 and 17 are arranged to slide over each other as soon as skirt 15 penetrates annular hollow 14. At that moment, when the screw is being driven in rotation, skirt 15 moves away, which causes its peripheral region or end portion 18 to tighten radially against external wall 19 of annular hollow 14. The tightening effort of the screw in the bar is thus exerted radially which protects the screw thread and the inner thread of the bar hole. It will also be mentioned that the end 34 of skirt 15 is stopped, at the end of screwing, against bottom 35 of annular hollow 14, which removes any risk of the screw head going beyond the sides of the bracelet, which is an obvious risk of the solution proposed by the aforecited CH Patent No. A-661185.

In this invention and depending upon the type of material used to make the bar, there is a risk of skirt 15 being permanently deformed, because of its spreading apart while the screw is being tightened. This can make the bar unable to be reused if the bracelet has to be dismantled, for example for cleaning or to adjust the length. In order to avoid this, at least one longitudinal slot 20 can be made in skirt 15 which encourages an elastic deformation of the latter.

A bracelet with hinged links fitted with a reliable hinging device able to be assembled and dismantled a large number of times, without damaging either the screws or the bars receiving the screws has thus been provided.

The illustrations also show that bar 5 is a solid rod whose first end 8 is machined to receive screw 11 and whose second end 21 has a head 22 integral with the solid rod. This head 22 is arranged to limit the axial clearance of bar 5. In order to do this, FIG. 1 shows that head 22 includes an overhang 37 capable of abutting against a shoulder 38 made in link 30.

It will be understood that the invention is not limited to the foregoing description. For example, bar 5 could include a screw 11 at each of its ends. Likewise, bar 5 could not be solid and have the shape of a tube machined at each of its ends to receive a screw.

What is claimed is:

1. A hinging device for pivotably attaching at least two links of a bracelet one after the other, this device including a bar passing into bars arranged in links, said bar comprising at least one of its ends, a hole provided with an inner thread, said device further including a screw having a thread engaged in said inner thread and a head arranged for limiting the axial clearance of said bar, wherein the bar and the screw are provided with means allowing an end portion (18) of the bar to exert a radial pressure on a portion of the screw head to tighten said screw in said bar.

2. The hinging device according to claim 1, wherein the screw head includes an annular hollow on its back part, wherein the end portion of the bar includes a skirt capable of penetrating said annular hollow and wherein between the threaded part of the screw and its head there is arranged a first truncated section arranged to cooperate with a second truncated section and wherein said second truncated section is arranged between the inner thread of the hole of the bar and its skirt, said first and second truncated sections being arranged to slide over one another as soon as the skirt penetrates the annular hollow to move said skirt apart when the screw is driven in rotation, the movement apart of said skirt causing its peripheral region to be tightened against the external wall of said annular hollow.

3. The hinging device according to claim 2, wherein the skirt has at least one longitudinal slot.

4. The hinging device according to claim 1, wherein the bar is a solid rod whose first end is machined to receive said screw and whose second end has a head integral with the solid rod, said head being arranged to limit the axial clearance of the bar.

5. A hinging device for pivotably attaching at least two links of a bracelet one after the other, this device including a bar passing into bars arranged in links, said bar comprising at least one of its ends, a hole provided with an inner thread, said device further including a screw having a thread engaged in said inner thread and a head arranged for limiting the axial clearance of said bar, wherein the bar and the screw are provided with means allowing an end portion (18) of the bar to rest radially on a portion of the screw head to tighten said screw in said bar, wherein the screw head includes an annular hollow on its back part, wherein the end portion of the bar includes a skirt capable of penetrating said annular hollow and wherein between the threaded part of the screw and its head there is arranged a first truncated section arranged to cooperate with a second truncated section and wherein said second truncated section is arranged between the inner thread of the hole of the bar and its skirt, said first and second truncated sections being arranged to slide over one another as soon as the skirt penetrates the annular hollow to move said skirt apart when the screw is driven in rotation, the movement apart of said skirt causing its peripheral region to be tightened against the external wall of said annular hollow.

6. The hinging device according to claim 5, wherein the skirt has at least one longitudinal slot.

7. The hinging device according to claim 5, wherein the bar is a solid rod whose first end is machined to receive said screw and whose second end has a head integral with the solid rod, said head being arranged to limit the axial clearance of the bar.

* * * * *